United States Patent [19]

Bowman et al.

[11] Patent Number: 4,871,648

[45] Date of Patent: Oct. 3, 1989

[54] STRIPPING LAYERS FOR IMAGING ELEMENTS

[75] Inventors: Wayne A. Bowman, Walworth; Daniel J. Harrison, Rochester, both of N.Y.

[73] Assignee: Eastman Kodak Company, Rochester, N.Y.

[21] Appl. No.: 229,363

[22] Filed: Aug. 5, 1988

[51] Int. Cl.[4] ..... G03C 5/54; G03C 1/90

[52] U.S. Cl. ..... 430/215; 430/227; 430/263

[58] Field of Search ..... 430/215, 227, 263

[56] References Cited

U.S. PATENT DOCUMENTS

| | | | |
|---|---|---|---|
| 2,977,266 | 3/1961 | Land | 430/207 |
| 3,220,835 | 11/1965 | Land | 430/227 |
| 3,730,718 | 5/1973 | Danhauser | 430/236 |
| 3,820,999 | 6/1974 | Tsuji et al. | 430/227 |
| 4,377,632 | 3/1983 | Pflingston | 430/218 |
| 4,459,346 | 7/1984 | Bishop et al. | 430/215 |
| 4,504,569 | 3/1985 | Abel et al. | 430/215 |
| 4,629,677 | 12/1986 | Katoh | 430/263 |

FOREIGN PATENT DOCUMENTS 121141 10/1984 European Pat. Off. .

*Primary Examiner*—Richard L. Schilling
*Attorney, Agent, or Firm*—Harold E. Cole

[57] ABSTRACT

Imaging elements, in particular image transfer assemblages and processes, are described wherein a stripping layer is employed to enable a layer containing a viewable image to be separated from other portions of the element. The stripping layer comprises certain N-alkyl substituted acylamide copolymers.

10 Claims, No Drawings

STRIPPING LAYERS FOR IMAGING ELEMENTS

This invention relates to imaging elements, particularly to black-and-white and color image transfer assemblages wherein certain N-alkyl acrylamide stripping agents are employed to enable an imaged layer to be separated from other portions of the element. Transparencies or prints which are less bulky can thereby be obtained from integral assemblages.

Various formats for color, integral transfer elements are described in the prior art, such as U.S. Pat. Nos. 3,415,644; 3,415,645; 3,415,646; 3,647,437; 3,635,707; 3,756,815, and Canadian Patent Nos. 928,559 and 674,082. In these formats, an image-receiving layer containing a photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image gathering layers begin to diffuse throughout the structure. At least a portion of the imagewise distribution of diffusible dyes diffuse to the dye image-receiving layer to form an image of the original subject. The user does not have to time this process.

A problem with the integral assemblages described above is that the silver halide and other imaging layers, the spent pod which originally contained processing fluid, and the trap which retains excess processing fluid remain with the print after processing. The resulting prints are bulky and are somewhat difficult to stock or store in albums.

Peel-apart formats for color diffusion transfer assemblages have previously been described, for example, in U.S. Pat. Nos. 2,983,606, 3,362,819 and 3,362,821. In these formats, the image-receiving element must be separated from the photosensitive element after a certain amount of time has elapsed, usually about one minute. This requires the customer to time the process which may be a disadvantage if a clock is not available. Also, the portion of the assemblage to be discarded is wet with caustic processing fluid, and care must be taken with its handling.

It would be desirable to provide a diffusion transfer assemblage in which a print can be obtained without the spent imaging layers, pod and trap, as in the peel-apart format described above, but with the elimination of the necessity for timing the process and the handling of wet discarded materials, as in the integral format described above. Such a print would comprise the support, dye image-receiving layer and reflecting layers only, and would more closely resemble conventional prints in appearance and handling. These advantages are provided by our invention.

Stripping layers have been previously employed in diffusion transfer photography as shown, for example, in U.S. Pat. Nos. 2,977,226, 3,220,835, 3,730,718, 3,820,999, 4,377,632 and 4,459,346. The materials described in these patents for the stripping layer include gum arabic, sodium alginate, pectin, cellulose acetate hydrogen phthal ate, polyvinyl alcohol, hydroxyethyl cellulose, polymethacrylic acid, plasticized methyl cellulose, ethyl cellulose, methyl methacrylate, butyl methacrylate and perfluoroalkylated esters or ethers.

A stripping layer for a integral diffusion transfer assemblage has many requirements. It must be easily coatable. Dye passage to the image receiving layer must not be hindered. The layers of the assemblage must not crack or separate upon bending and handling. The assemblage must maintain integrity during storage, during the high pH of processing and during the time when the pH is lowered by the process control layers, yet there must be easy and clean separation at the stripping layer after transfer of the image.

If the assemblage provides a transparency with high magnification projection, additional requirements for retention of image sharpness arise. To maintain sharpness the diffusion path must be as short as possible, thus a thin stripping layer is desired. If a stripping layer is used in a transparency image-transfer format and the stripping layer surface-interface remains visible to the user, clean separation is critical. Random areas that separate upon stripping even if not visible during projection viewing are undesirable if viewable on the surface.

Photographic elements other than image transfer elements can employ stripping agents. For example, in the publication of catalogues with many items in one page, it is customary to assemble the several images on one page by photographing the various items on a transparency film and then dissolve away the film support in a solvent such as acetone to leave the emulsion layer containing the image as a very thin layer, which can be trimmed and placed, or dropped into the page assembly with very little edge deformation. The use of solvent to dissolve the film support is slow and noxious. A stripping layer has been coated between the film support and the emulsion layer. This provides a much simpler way to release the emulsion layer from the support.

There is a need for improved stripping layers which are coatable from aqueous solutions and which permit clean separation between the stripping layer and an adjacent layer.

We have found that certain N-alkyl substituted acrylamide copolymers provide advantageous stripping layers for photographic elements.

Materials employed in the stripping layer of our invention have previously been used in photographic elements. In U.S. Pat. No. 4,504,569, issued Mar. 12, 1985, N-alkyl substituted acrylamide polymers are shown in temporary barrier layers. In European published Patent Application No. 121,141 published Oct. 10, 1984 they are described as gelatin extenders. Neither of these publications discloses that certain N-alkyl substituted acrylamide polymers would be useful as stripping agents.

In accordance with our invention there is provided a photographic element for forming a viewable image comprising a support, a silver halide emulsion layer and a stripping layer therebetween, the improvement wherein the stripping layer comprises an N-alkyl substituted acrylamide copolymer in such location, concentration and composition that clean separation between the stripping layer and an adjacent layer is obtained.

In one embodiment of our invention the viewable image is formed in the silver halide emulsion layer. In another embodiment of our invention the viewable image is transferred to a mordant layer between the support and the stripping layer.

An image transfer assemblage according to our invention comprises:

(a) a photosensitive element comprising a support having thereon at least one photosensitive silver halide emulsion layer; and (b) an image-receiving layer, and wherein the assemblage contains a stripping layer comprising an N-alkyl substituted acrylamide copolymer in such a concentration, location and composition that the image-receiving layer may be separated, after processing, from the rest of the assemblage, and that the separated image-receiving layer will have substantially none of the emulsion layer adhered thereto.

In forming a black-and-white image in an image transfer assemblage, the exposed photosensitive element is developed. In the unexposed areas, a silver halide complexing agent dissolves the silver halide and transfers it to the image-receiving layer. Silver precipitating nuclei in the image-receiving layer then cause the transferred silver halide complex to be reduced to silver, thereby forming an image pattern corresponding to the original. Details of the process are well known to those skilled in the art as shown, for example, by U.S. Pat. Nos. 3,220,835 and 3,820,999 discussed above, the disclosure of which are hereby incorporated by reference.

In a preferred embodiment of our invention, the silver halide emulsion layer has associated therewith a dye image-providing material.

In another preferred embodiment of our invention, the N-alkyl acrylamide copolymer has the following formula:

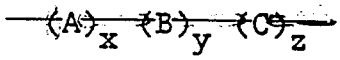

where:

A represents randomly recurring units of one or more hydrolphilic polymerized N-alkyl- or N,N-dialkylacrylamides;

B represents randomly recurring units of one or more polymerized nonionic alkyl-, hydroxyalkyl-, or oxaalkyl-acrylate or methacrylate monomers, or a carboxylic acid group containing monomer;

C represents randomly recurring units of one or more polymerized cross-linking monomers having two or more polymerizable groups;

x, y and z represent the weight percent of the A, B and C recurring units, respectively x represents 30 to 90 weight percent;

y represents 0 to 60 weight percent, no more than 5 weight percent being a polymerized carboxylic acid group containing monomer;

z represents 0 to 15 weight percent;

the sum of y and z represents 10 to 70 weight percent; and the sum of x, y and z represents 100 weight percent.

Variations of the C monomer affect physical integrity of the polymer.

To be optimally useful in this invention, the ratio of the A, B and C comonomers are adjusted within the ranges specified to give a wet peel separation force of between 0.4 and 4.0 g/cm. Wet peel separation force is that force needed to cleanly separate the stripping layer, present at 0.5 to 1.5 g/m$^2$ of copolymer, from an adjacent layer after the element has been wetted with the processing composition used to form an image for 10 minutes at 20° C. By clean separation is meant that the stripping layer separated at one or the other of the interfaces with the adjacent layers, and does not separate internal to the stripping layer. If the force required to provide clean separation is below about 0.4 g/cm, there is the danger of spontaneous delamination of the element. If the force is much above 4.0 g/cm, there may be undue difficulty in separating the layers. Application of this test to identify optimum materials for image transfer assemblages as illustrated in Example 1, infra.

Suitable comonomers for use in this invention include:

A1: N-Isopropylacrylamide
A2: N,N-Dimethylacrylamide
A3: N-n-propylacrylamide
A4: N-n-butylacrylamide B1: 2-Ethoxyethyl acrylate
B2: 2-Ethoxyethyl methacrylate
B3: Methyl acrylate
B4: Methyl methacrylate
B5: n-Butyl acrylate
B6: n-Butyl methacrylate
B7: Ethyl acrylate
B8: Pentaethyleneglycol methacrylate
B9: Decaethyleneglycol methyacrylate
B10: Didecylethyleneglycol methacrylate
B11: 2-Hydroxyethyl acrylate
B12: 2-Hydroxyethyl methacrylate
B13: 3-Chloro-2-hydroxypropyl methacrylate
B14: Hexafluoro-1,1-3-trihydrobutyl acrylate
B15: Trifluoroethyl acrylate
B16: Acrylamide
B17: N-(1,1-dimethyl-3-oxobutyl)acrylamide
B18: Acrylic Acid
B19: Methacrylic acid C1: Ethyleneglycol dimethacrylate
C2: N,N'-Methylenebisacrylamide
C3: Polyethyleneglycol diacrylate
C4: Polyethyleneglycol dimethylacrylate Preferred A, N-alkyl substitute acrylamide monomers are:

A-1: N-Isopropylacrylamide
A-2: N,N-Dimethylacrylamide

Preferred B, ester comonomers are:

B-1: 2-Ethoxyethyl acrylate
B-4: Methyl methacrylate
B-6: n-Butyl methacrylate
B-12: 2-Hydroxyethyl methacrylate, Any one of which may be used along or with 1 to 2 weight percent of acrylic acid or methacrylic acid to increase hydrophilic properties.

Preferred C, cross-linking comonomers are:

C-1: Ethyleneglycol dimethacrylate
C-2: N,N'-Methylenebisacrylamide

Preferred polymers are:

Poly(N,N-dimethylacrylamide-co-n-butyl methacrylate-co-ethyleneglycol dimethylacrylate) (50:40:10 wt ratio)

Poly(N-isopropylacrylamide-co-2-hydroxyethyl methacrylate-co-N,N'-methylenebisacrylamide) (70:20:10 wt ratio)

Poly(N-isopropylacrylamide-co-methyl methacrylate-co-N,N'-methylene bisacrylamide) (80/10/10 wt ratio)

Poly(N,N-dimethylacrylamide-co-n-butylmethacrylate) (50/50 wt ratio)

Poly(N,N-dimethylacrylamide-co-trifluoroethyl acrylate) (60/40 wt ratio)

Poly(N,N-dimethylacrylamide-co-2-hydroxyethyl methacrylate-co-ethyleneglycol dimethacrylate) (30/60/10 wt ratio)

The copolymer employed in our invention may be employed in any amount which is effective for the intended purpose, i.e., clean separation between the stripping layer and an adjacent layer. In general, good results have been obtained at a concentration of from about 5 to about 500 mg/m$^2$ of element. The particular amount to be employed will vary, of course, depending on the particular stripping agent employed and the composition of other layers of the assemblage.

Our invention can be used in diffusion transfer assemblages where a reflection print is obtained without the bulkiness of silver halide and other layers, the spent pod and trip. In other words, our invention combines the handling and storage characteristics of conventional photographs with the convenience and benefits of instant photography. in addition, transparency elements can also be obtained with our invention which requires a transparent support and the removal of residual image dye, silver halide and opacifying layers. By removing the silver halide and dye image-providing material layers from the assemblage, there is also provided the option of recovery of these expensive materials from the discarded portion of the assemblage, if it is economically feasible to do so.

Our invention can also be used in other photographic environments where stripping layers have been used.

The preferred location for our stripping layer is adjacent to the mordant or image-receiving layer. It could also be located in other positions in the assemblage, such as between pigmented gelatin vehicle layers, or adjacent the emulsion layer if desired.

A process for producing a photographic image in color according to our invention comprises:

(I) exposing a photosensitive element comprising a support having thereon at least one photosensitive silver halide emulsion layer having associated therewith a dye image-providing material;

(II) treating the element with an alkaline polymer thickened processing composition in the presence of a silver halide developing agent to effect development of each exposed silver halide emulsion layer, whereby:

(a) an imagewise distribution of the dye image-providing material is formed as a function of the development of the silver halide emulsion layer; and (b) at least a portion of the imagewise distribution of the dye image-providing material diffuses to a dye image-receiving layer; and (III) separating the dye image-receiving layer from the rest of the photosensitive element by means of a stripping agent as described above, in such a concentration that the separated dye image-receiving layer will have substantially none of the emulsion layer adhered therebetween.

The photographic element in the above-described process can be treated with an alkaline processing composition to effect or initiate development in any manner. A preferred method for applying processing composition is by use of a rupturable container or pod which contains the composition.

In a preferred embodiment of our invention the photographic assemblage comprises:

(a) a photosensitive element comprising a support having thereon at least one silver halide emulsion layer having associated therewith a dye image-providing material;

(b) a transparent cover sheet located over the layer outermost from the support of the photosensitive element;

(c) a dye image-receiving layer located either in the photosensitive element or on the transparent cover sheet; and (d) an alkaline processing composition and means containing same for discharge between the photosensitive element and the transparent cover sheet;

and wherein the assemblage contains a stripping agent as described above.

In a preferred embodiment of the invention, the means containing the alkaline processing composition is a rupturable container or pod which is adapted to be positioned during processing of the film unit so that a compressive force applied to the container by pressure-applying members, such as would be found in a camera designed for in-camera processing, will effect a discharge of the container's contents within the film unit. In general, the processing composition employed in this invention contains the developing agent for development, although the composition could also just be an alkaline solution where the developer is incorporated in the photographic element or cover sheet, in which case the alkaline solution serves to activate the incorporated developer.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Patent No. 602,607. In a preferred embodiment of this invention, the dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Patent No. 2,854,946, the disclosures of which are hereby incorporated by reference.

A format for integral negative-receiver photographic elements in which the present invention is useful is disclosed in Canadian Patent No. 928,559. In this embodiment, the support for the photographic element is transparent and is coated with the image-receiving layer, a substantially opaque, light-reflective layer and the photosensitive layer or layers described above. A rupturable container, containing an alkaline processing composition including a developing agent and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Patent No. 928,559.

Still another useful integral formats in which this invention can be employed are described in U.S. Pat. Nos. 3,415,644; 3,415,645; 3,415,646; 3,647,437 and 3,635,7070. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photosensitive element would comprise a support having thereon, in sequence, a neutralizing layer, a timing layer and at least one photosensitive silver halide emulsion layer having associated therewith a dye image-providing material. The dye image-receiving layer would be provided on transparent cover sheet with the processing composition being applied thereto The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m_2$ has been found to be useful. The dye image-providing material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, catechol compounds, and 3-pyrazolidinone compounds as disclosed in column 16 of U.S. Pat. No. 4,358,527, issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In the embodiments of this invention, in which dye image-providing materials can be used which produce diffusible dye images as a function of development, either conventional negative-working or direct-positive silver halide emulsions can be employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted dye image-providing materials. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye image-providing material compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid-and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

The following multilayer elements are coated in the order indicated on a clear poly(ethylene terephthalate) support:

7. Overcoat layer: gelatin (6.5 g/m$^2$)
6. Opaque layer: carbon (0.89 g/m$^2$), gelatin (0.57 g/m$^2$)
5. Stripping layer: indicated polymer coated at 1.1 g/m$^2$
4. Interlayer: gelatin (0.54 g/m$^2$)
3. Opaque layer: carbon (1.9 g/m$^2$), gelatin 1.2 g/m$^2$)
2. Reflecting layer: titanium dioxide (19. g/m$^2$) gelatin (3.0 g/m$^2$)
1. Mordant layer: poly(styrene-co-N-dimethyl-N-vinylbenzylammonium chloride-co-divinylbenzene) (99:99:2) weight ratio) (2.3 g/m$^2$), gelatin (2.3 g/m$^2$).

Pods containing the following polymer thickened processing composition were prepared:

Potassium hydroxide: 35. g/l water
Potassium bromide: 2.0 g/l
11-Aminoundecanoic acid: 3.0 g/l
5-Methylbenzotriazole: 3.0 g/l
Carbon: 360. g/l
Carboxymethylcellulose: 167. g/l
Tamol SN ®6.0 g/l Cover sheets (acid-timing layers) like those of layers 2 and 1 of U.S. 4,353,973 of Wheeler were prepared.

The wet stripping performance of each integral imaging receiver was evaluated by laminating an element to a cover sheet by spreading the viscous processing composition in a pod at room temperature of 20° C., using a pair of 75 μm gap undercoat rollers. After 10 minutes lamination time, two strips 2.5 cm×12.5 cm were cut and the force required to separate the laminated pair was measured as g/cm force using an Instron Universal Testing Machine Model TM-1122. The separation forces required and limitations on the ability to peel are tabulated below. Forces of between 0.4 and 4.0 g/cm are considered acceptable.

The following stripping layer polymers within the composition definition of the invention showed peel force within the test criteria:

| | Polymer | | Peel Force |
|---|---|---|---|
| | Monomers | Weight Ratio: A/B/C | (g/cm) |
| E-1 | A1/B4 | 70/30/0 | 3.2 |
| E-2 | A1/C2 | 90/10/0 | 1.6 |
| E-3 | A1/B1/C2 | 70/20/10 | 2.0 |
| E-4 | A1/B4/C2 | 80/10/10 | 0.8 |
| E-5 | A1/B8/C2 | 60/30/10 | 2.0 |
| E-6 | A1/B12/C1 | 70/20/10 | 1.6 |
| E-7 | A1/B12/C2 | 70/20/10 | 1.2 |
| E-8 | A1/B16/C2 | 80/10/10 | 2.0 |
| E-9 | A1/B19/C2 | 89/1/10 | 1.2 |
| E-10 | A1/B4,18/C2 | 80/9,1/10 | 1.6 |
| E-11 | A1/B4,19/C2 | 75/10,5/10 | 2.4 |
| E-12 | A1/B12,18/C2 | 80/9,1/10 | 1.6 |
| E-13 | A1/B12,19/C2 | 75/10,5/10 | 1.2 |
| E-14 | A1,2/C2 | 70,20/0/100 | 2.0 |
| E-15 | A1,2/B6/C1 | 20,30/40/10 | 1.2 |
| E-16 | A1,2/B19/C2 | 80,9/1/10 | 2.4 |
| E-17 | A1,2/B19/C2 | 75/10/5/10 | 1.6 |
| E-18 | A2/B4 | 50/50/0 | 1.2 |
| E-19 | A2/B6 | 50/50/0 | 0.4 |
| E-20 | A2/B14 | 80/20/0 | 1.2 |
| E-21 | A2/B15 | 60/40/0 | 0.8 |
| E-22 | A2/B3/C1 | 30/60/10 | 1.6 |
| E-23 | A2/B5/C1 | 50/40/10 | 1.6 |
| E-24 | A2/B5/C3 | 40/50/10 | 1.2 |
| E-25 | A2/B5/C4 | 30/60/10 | 1.6 |
| E-26 | A2/B6/C1 | 50/40/10 | 1.2 |
| E-27 | A2/B10,C1 | 40/50/10 | 2.0 |
| E-28 | A2/B12/C1 | 30/60/10 | 0.8 |
| E-29 | A2/B14/C1 | 50/40/10 | 1.2 |
| E-30 | A2/B15/C1 | 40/50/10 | 1.6 |
| E-31 | A2/B6,13/C1 | 50/30,10/10 | 3.2 |

The following stripping layer polymers do not satisfy the composition definition of the invention. They failed to show satisfactory peel performance.

| | Polymer | | Peel Force |
|---|---|---|---|
| | Monomers | Weight Ratio: A/B/C | (g/cm) |
| F-1 | A2 | 100/0/0 | (a) |
| F-2 | B1 | 0/100/0 | (a) |
| F-3 | B2 | 0/100/0 | (a) |
| F-4 | B1,3 | 0/70,30/0 | (a) |
| F-5 | B1,18 | 0/70/30/0 | (b) |
| F-6 | B4,17/C2 | 0/20,70/10 | (a) |
| F-7 | B6/C1 | 0/90/10 | (a) |
| F-8 | B6,16/C1 | 0/70,20/10 | (a) |
| F-9 | B16 | 0/100/0 | (a) |
| F-10 | B16,18 | 0/80,20/0 | (a) |
| F-11 | B11,17/C2 | 0/20,70/10 | (a) |

(a) Stripping occurs at a location other than adjacent the stripping layer
(b) Failure to strip The following stripping layer polymers satisfy the composition definition of the invention but do not satisfy the peel force criteria. They failed to show satisfactory peel performance.

| | Polymer | | Peel Force |
|---|---|---|---|
| | Monomers | Weight Ratio: A/B/C | (g/cm) |
| F-12 | A1B1 | 30/70/0 | (a) |
| F-13 | A1/B5/C2 | 70/20/10 | (a) |
| F-14 | A1/B9/C2 | 60/30/10 | (a) |
| F-15 | A2/B1 | 30/70/0 | (a) |
| F-16 | A2/B1/C1 | 30/60/10 | (a) |
| F-17 | A2/B4/C1 | 30/60/10 | (a) |
| F-18 | A2/B7/C1 | 40/50/10 | (a) |
| F-19 | A2/B6,19/C1 | 40/45,5/10 | (a) |

(a) Stripping occurs at processing fluid interface rather than at stripping layer itself The invention has been described in detail with particular reference to preferred embodiments thereof, but it will be understood that variations and modifications can be effected within the spirit and scope of the invention.

What is claimed is

1. In a photographic element for forming a viewable image comprising a support, a silver halide emulsion layer and a stripping layer therebetween, the improvement wherein the stripping layer comprises an N-alkyl substituted acrylamide copolymer in such location, concentration and composition that clean separation between the stripping layer and an adjacent layer is obtained, said copolymer having the formula:

$$-(A)_x-(B)_y-(C)_z$$

where:

A represents randomly recurring units of one or more hydrophilic polymerized N-alkyl- or N,N-dialkylacrylamides;

B represents randomly recurring units of one or more polymerized nonionic alkyl-, hydroxyalkyl-, or oxaalkyl-acrylate or methacrylate monomers, or a carboxylic acid group containing monomer;

C represents randomly recurring units of one or more polymerized cross-linking monomers having two or more polymerizable groups;

x, y and z represent the weight percent of the A, B and C recurring units, respectively x represents 30 to 90 weight percent;

y represents 0 to 60 weight percent, no more than 5 weight percent being a polymerized carboxylic acid group containing monomer;

z represents 0 to 15 weight percent;

the sum of y and z represents 10 to 70 weight percent; and the sum of x, y and z represents 100 weight percent.

2. The photographic element of claim 1 wherein the viewable image is formed in the silver halide emulsion layer.

3. The photographic element of claim 1 wherein said silver halide emulsion layer has a diffusible dye image-forming material associated therewith so that a viewable image can be formed in a mordant layer which is between the support and the stripping layer.

4. The photographic element of claim 1 wherein the composition of the N-alkyl substituted acrylamide copolymer is such that clean separation between the stripping layer and an adjacent layer is obtaining when the element is wetted with processing composition for 10 minutes at 20° C. and then a peel force of between 0.4 and 4.0 g/cm is applied.

5. In a photographic assemblage comprising:

(a) a photosensitive element comprising a support having thereon at least one photosensitive silver halide emulsion layer; and (b) an image-receiving layer, the improvement wherein said assemblage contains a stripping layer comprising an N-alkyl substituted acrylamide copolymer in such a location, concentration and composition that said image-receiving layer may be separated, after processing, from the rest of said assemblage, and that said separated image-receiving layer will have substantially none of said emulsion layer adhered thereto, said copolymer having the formula:

$$-A_xB_yC_z$$

where:

A represents randomly recurring units of one or more hydrophilic polymerized N-alkyl- or N,N-dialkylacrylamides;

B represents randomly recurring units of one or more polymerized nonionic alkyl-, hydroxyalkyl-, or oxaalkyl-acrylate or methacrylate monomers, or a carboxylic acid group containing monomer;

C represents randomly recurring units of one or more polymerized cross-linking monomers having two or more polymerizable groups;

x, y and z represent the weight percent of the A, B and C recurring units, respectively x represents 30 to 90 weight percent;

y represents 0 to 60 weight percent, no more than 5 weight percent being a polymerized carboxylic acid group containing monomer;

z represents 0 to 15 weight percent;

the sum of y and z represents 10 to 70 weight percent; and the sum of x, y and z represents 100 weight percent.

6. The assemblage of claim 5 which also contains an alkaline processing composition containing a silver halide developing agent and means containing same for discharge within said assemblage.

7. The assemblage of claim 6 wherein said image-receiving layer contains silver precipitating nuclei and said assemblage also contains a silver halide solvent or complexing agent.

8. The assemblage of claim 6 wherein said silver halide emulsion layer has associated therewith a dye image-providing material.

9. The element of claim 1 wherein comonomer A is
N-Isopropylacrylamide or
N,N-Dimethylacrylamide;
comonomer B is
2-Ethoxyethyl acrylate,
Methyl methacrylate,
n-Butyl methacrylate or
2-Hydroxyethyl methacrylate; and
comonomer C is
Ethyleneglycol dimethacrylate or
N,N'-Methylenebisacrylamide.

10. The element of claim 1 wherein the polymer is
Poly(N,N-dimethylacrylamide-co-n-butyl methacrylate-co-ethyleneglycol dimethylacrylate) (50:40:10 wt ratio);
Poly(N-isopropylacrylamide-co-2-hydroxyethyl methacrylate-co-N,N'-methylenebisacrylamide) (70:20:10 wt ratio);
Poly(N-isopropylacrylamide-co-methyl methacrylate-co-N,N'-methylene bisacrylamide) (80/10/10 wt ratio);
Poly(N,N-dimethylacrylamide-co-n-butylmethacrylate)(50/50 wt ratio);
Poly(N,N-dimethylacrylamide-co-trifluoroethyl acrylate) (60/40 wt ratio); or
Poly(N,N-dimethylacrylamide-co-2-hydroxyethyl methacrylate-co-ethyleneglycol dimethacrylate) (30/60/10 wt ratio).

* * * * *